US012533568B1

(12) United States Patent
Hawkins

(10) Patent No.: US 12,533,568 B1
(45) Date of Patent: Jan. 27, 2026

(54) GAME BOARD ASSEMBLY

(71) Applicant: Ronald C Hawkins, Taylor, TX (US)

(72) Inventor: Ronald C Hawkins, Taylor, TX (US)

( * ) Notice: Subject to any disclaimer, the term of this patent is extended or adjusted under 35 U.S.C. 154(b) by 455 days.

(21) Appl. No.: 18/183,670

(22) Filed: Mar. 14, 2023

(51) Int. Cl.
*A63F 3/00* (2006.01)

(52) U.S. Cl.
CPC ..... *A63F 3/00261* (2013.01); *A63F 3/00574* (2013.01); *A63F 2003/00627* (2013.01)

(58) Field of Classification Search
CPC ..... A63F 3/00094; A63F 3/00261; A63F 3/00574
See application file for complete search history.

(56) References Cited

U.S. PATENT DOCUMENTS 642,903 A * 2/1900 Hachmuth ..... A63B 67/06 273/401
653,303 A * 7/1900 Macdonald ..... A63F 3/00094 273/271
713,275 A * 11/1902 Atkins ..... A63F 7/02 473/475
713,704 A * 11/1902 Smith ..... F41J 3/0047 273/348.5
742,927 A * 11/1903 Stults ..... A63B 67/06 273/401
823,507 A * 6/1906 Carr ..... A63B 67/06 273/401
850,224 A * 4/1907 Haskell ..... A63F 7/0612 273/317.5
935,755 A * 10/1909 Grundy ..... A63F 3/00094 273/271
957,800 A * 5/1910 Richardson ..... A63F 3/00094 273/271
1,527,988 A * 3/1925 Mcmurtrie ..... A63B 63/08 473/196
1,616,270 A * 2/1927 Madden ..... A63F 9/0204 273/342
2,313,473 A * 3/1943 Heacock ..... A63F 3/00094 108/17
3,638,948 A * 2/1972 Smith ..... A63F 3/00 273/282.1
3,747,931 A * 7/1973 Tuan ..... A63F 3/00094 273/237
3,749,401 A * 7/1973 Hayko ..... A63F 9/0204 273/389
3,781,013 A * 12/1973 Von Meyer ..... A63F 3/00094 273/287
3,877,699 A * 4/1975 Reiner ..... A63F 7/0076 273/129 R (Continued)

FOREIGN PATENT DOCUMENTS

KR 20240025748 A * 2/2024 ..... G09B 1/08

*Primary Examiner* — Morgan T Jordan
(74) *Attorney, Agent, or Firm* — The Buche Law Firm, P.C.; Bryce A. Johnson; John K. Buche

(57) ABSTRACT

A game board assembly is configured to do play an adjacent ball game. The game board assembly has a game board further comprising thirty-six cavities arranged in a six-by-six grid. A plurality of posts is arranged above, beneath, to the left and to the right of each cavity. A plurality of rubber bands is wrapped around each row of the plurality of posts. Netting posts are arranged on outer edges of the game board. A net is arranged on the netting posts. bouncing a ball onto the game board results in the ball being directed in to one of the thirty-six cavities.

20 Claims, 9 Drawing Sheets

(56) References Cited

U.S. PATENT DOCUMENTS 3,879,040 A * 4/1975 Smith ..... A63F 3/00094 273/282.1
3,913,918 A * 10/1975 Trachtman ..... A63F 7/0668 273/126 R
3,958,806 A * 5/1976 Brown ..... A63B 63/06 473/485
4,037,838 A * 7/1977 McCune ..... A63B 67/04 108/65
4,141,561 A * 2/1979 Spitzner ..... A63F 3/00 116/323
4,228,596 A * 10/1980 Daniel ..... A63F 3/00094 273/237
4,324,406 A * 4/1982 Ocampo ..... A63F 3/02 273/272
4,440,395 A * 4/1984 Hyland ..... A63F 3/00094 273/287
4,573,689 A * 3/1986 Sultzbaugh ..... A63F 9/0208 273/145 R
4,585,235 A * 4/1986 Williams ..... A63F 7/2409 273/357
4,620,709 A * 11/1986 Palladino, Jr. ..... A63F 7/0076 273/271
4,647,049 A * 3/1987 Oretsky ..... A63F 3/00094 273/287
4,651,996 A * 3/1987 Watkins, Jr. ..... A63F 3/00094 273/271
4,726,592 A * 2/1988 Callaham ..... A63B 63/08 273/342
4,736,955 A * 4/1988 Pollock ..... A63B 67/06 273/DIG. 30
5,058,896 A * 10/1991 Bez ..... A63F 3/0423 273/272
5,277,419 A * 1/1994 Craig ..... A63F 3/00094 273/271
5,318,307 A * 6/1994 Bouchard ..... A63B 67/06 273/350
5,351,968 A * 10/1994 Starnes ..... A63B 63/007 273/DIG. 30
5,580,059 A * 12/1996 Marks ..... G07F 17/3276 273/271
5,613,681 A * 3/1997 Allen ..... A63F 7/00 273/153 R
5,655,773 A * 8/1997 Marks ..... G07F 17/3276 273/271
5,961,118 A * 10/1999 Chie ..... A63F 3/02 273/264
6,254,098 B1 * 7/2001 Kirkpatrick ..... A63F 3/00643 273/271
6,428,003 B1 * 8/2002 Fondin ..... A63F 3/00094 273/287
6,511,067 B1 * 1/2003 Butler ..... A63F 3/00094 273/242
D539,359 S * 3/2007 Rom ..... D21/478
7,207,565 B1 * 4/2007 Masty, III ..... A63B 67/06 273/342
7,311,610 B2 * 12/2007 Ochi ..... A63G 31/12 472/136
8,210,537 B1 * 7/2012 Ladhe ..... A63F 3/00094 463/9
8,523,184 B1 * 9/2013 Ershov ..... A63F 7/0612 273/317.1
8,651,492 B1 * 2/2014 Cappuccio ..... A63B 71/0036 273/398
11,660,513 B2 * 5/2023 Wickum ..... A63B 67/06 273/342
2002/0113370 A1 * 8/2002 Pickering ..... A63F 3/00094 273/237
2004/0072635 A1 * 4/2004 Clark ..... A63F 9/0204 473/478
2007/0184886 A1 * 8/2007 Floden ..... A63F 13/92 463/14
2009/0166971 A1 * 7/2009 Mebane ..... A63F 3/00094 273/153 R
2009/0194941 A1 * 8/2009 Boyd ..... A63B 67/007 273/340
2009/0278309 A1 * 11/2009 Miller ..... A63F 3/00214 273/153 R
2010/0105013 A1 * 4/2010 McCafferty ..... B65H 49/322 434/83
2010/0148440 A1 * 6/2010 Hart ..... A63F 3/00094 463/43
2011/0095479 A1 * 4/2011 Attwood ..... A63F 3/00094 273/271
2012/0256378 A1 * 10/2012 Brown ..... A63B 63/08 273/401
2013/0009362 A1 * 1/2013 Blanchard ..... A63F 3/00094 463/9
2014/0265120 A1 * 9/2014 Elwell ..... A63F 7/0023 273/242
2015/0335993 A1 * 11/2015 Attenweiler ..... A63F 7/0023 273/342
2018/0126255 A1 * 5/2018 Hotchkiss ..... A63F 3/00094
2018/0169509 A1 * 6/2018 Fechser ..... A63F 7/02
2022/0016514 A1 * 1/2022 Auchterlonie ..... A63F 3/00094
2022/0219071 A1 * 7/2022 Drake ..... G09B 1/02
2023/0082805 A1 * 3/2023 Vidalis ..... A63B 67/06 273/402
2025/0050201 A1 * 2/2025 Tokunaga ..... A63F 3/0052

* cited by examiner

GAME BOARD ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Not provided.

SUMMARY OF THE INVENTION

Disclosed may be:

a game board assembly, configured for playing an adjacent ball game, the game board assembly comprising:

a game board consisting of thirty-six cavities arranged in a six by six grid of cavities;

a plurality of posts, one post of the plurality of posts arranged above, beneath, to the left, and to the right of each cavity, for a total of four posts surrounding each cavity and a total of eighty-four posts arranged over the six by six grid of cavities;

wherein an alignment of six cavities defines a row of cavities, with a total of six rows of cavities spread over the six by six grid of cavities;

the game board further comprising thirteen rubber bands, where five of the thirteen rubber bands are separately wrapped around six aligned posts that are arranged between each two rows of cavities and where eight of the thirteen rubber bands are separately wrapped around three aligned posts that are not arranged between any rows of cavities, such that the five rubber bands define five fences across and within the six by six grid of cavities while the eight rubber bands define eight fences at least partially across and without the six by six grid of cavities;

netting posts uprightly arranged on the perimeter of the game board;

a net arranged on the netting posts such that the six by six grid of cavities is located within the net; and, wherein tossing a ball so that the ball bounces over the net onto the game board and within the six by six grid results in either the ball being directed into one of the thirty-six cavities by at least one of the thirteen rubber bands or the ball being on an outside of all of the thirty six cavities.

This game board assembly wherein each of the thirty-six cavities has a circular opening with a diameter of approximately ⅞ inch.

This game board assembly wherein the thirty-six cavities are spaced approximately 2 inches center-to-center from adjacent cavities.

This game board assembly wherein the game board has dimensions of approximately 15 inches by 15 inches.

This game board assembly further comprising a game board base having dimensions of approximately 18 inches by 18 inches by ¾ inch thickness.

This game board assembly wherein the eighty-four posts have dimensions of approximately 9/16 inch by ½ inch and stand approximately 1¾ to 1⅞ inches high.

This game board assembly wherein the thirteen rubber bands are constructed from durable rubber material.

This game board assembly wherein the net has a height of approximately 5½ inches surrounding all sides of the playing area.

This game board assembly wherein the netting posts comprise eight posts positioned around the outer edges of the game board base.

This game board assembly wherein the ball comprises a ping pong ball.

This game board assembly wherein the thirteen rubber bands are attached to top portions of the eighty-four posts.

This game board assembly wherein the five rubber bands positioned between rows of cavities prevent balls from settling in void areas between the cavities.

This game board assembly wherein the two rubber bands positioned outside the six by six grid provide perimeter fencing for the game board assembly.

This game board assembly wherein the net completely surrounds the six by six grid of cavities with no gaps for player access within the net.

This game board assembly wherein players must stand outside the net perimeter and bounce balls over the net to access the playing area.

This game board assembly wherein the game board assembly requires at least one foot clearance on all four sides for proper setup and gameplay.

This game board assembly wherein winning occurs when a player achieves four balls in a straight line, diagonal, two by two at center, or four corners pattern within the six by six grid.

This game board assembly wherein the game board assembly accommodates two, three, or four players, with four-player games using teams of two players.

This game board assembly wherein balls that do not clear the net may be replayed once per turn.

This game board assembly wherein the rubber band fencing system increases the probability that bounced balls will be directed into one of the thirty-six cavities rather than remaining in void areas between cavities . . .

DETAILED DESCRIPTION OF THE INVENTION

Game Board Play

Objective:

Using ping pong balls, players attempt to land the ball in to the slots with holes/cavities.

Scoring: Land four balls in a row, straight line, diagonally, or four corners.

Players: Take turns bouncing the ball from outside the netting onto the game board. If the bounce does not clear the netting, that ball can be replayed once. If the ball played correctly enters the game board but bounces back out, or within the netting without landing in the hole/cavity, it is a miss, and the play goes to the next player.

Figure 1:
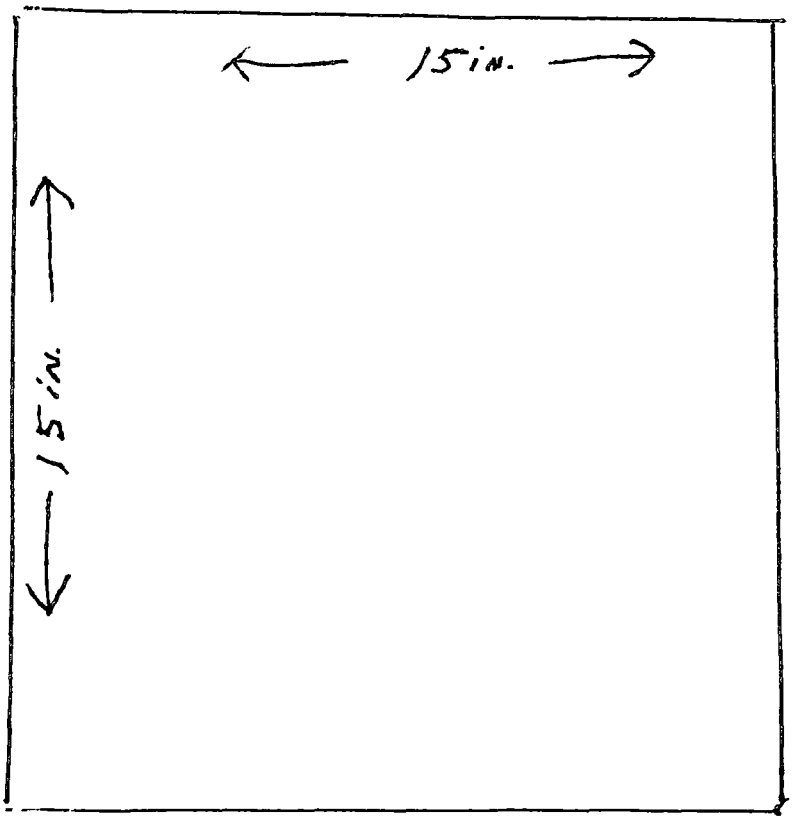
FIG. 1 shows main game board size 15"×15" to be placed on top of the game board base.
Figure 2:
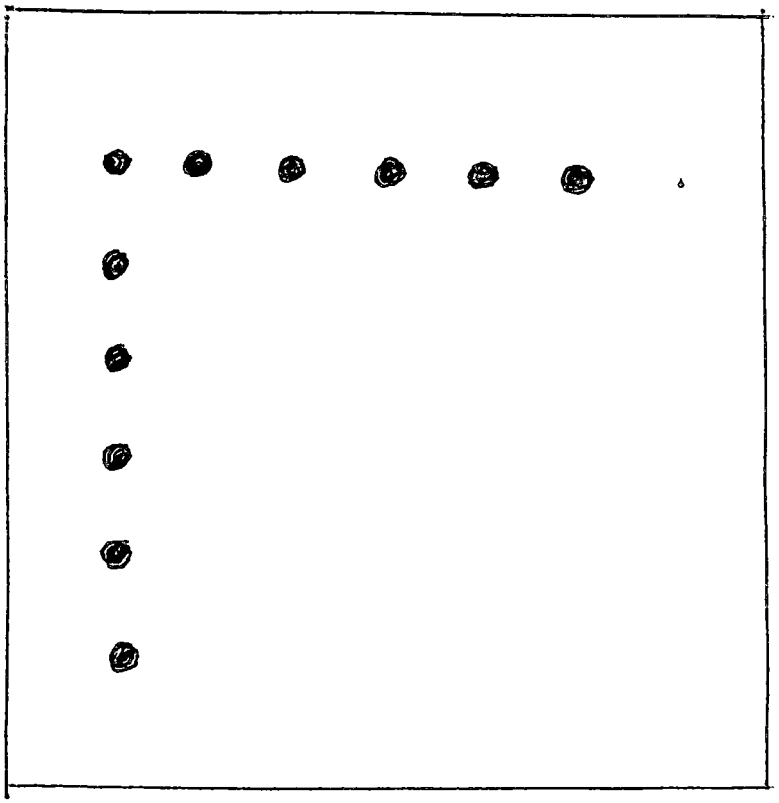
FIG. 2 shows placement of 36 holes/slots. Holes/slots are 7/18" placed 2" center apart starting 3" from each side.
Figure 3:
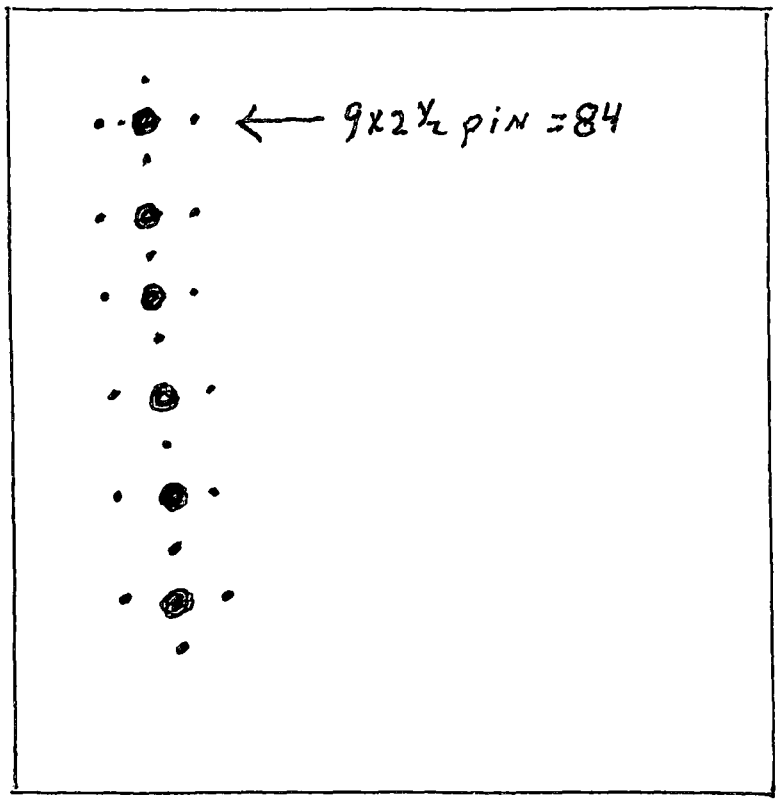
FIG. 3 shows placement of 84 9×½ pins placed on all four sides of holes/slots
Figure 4:
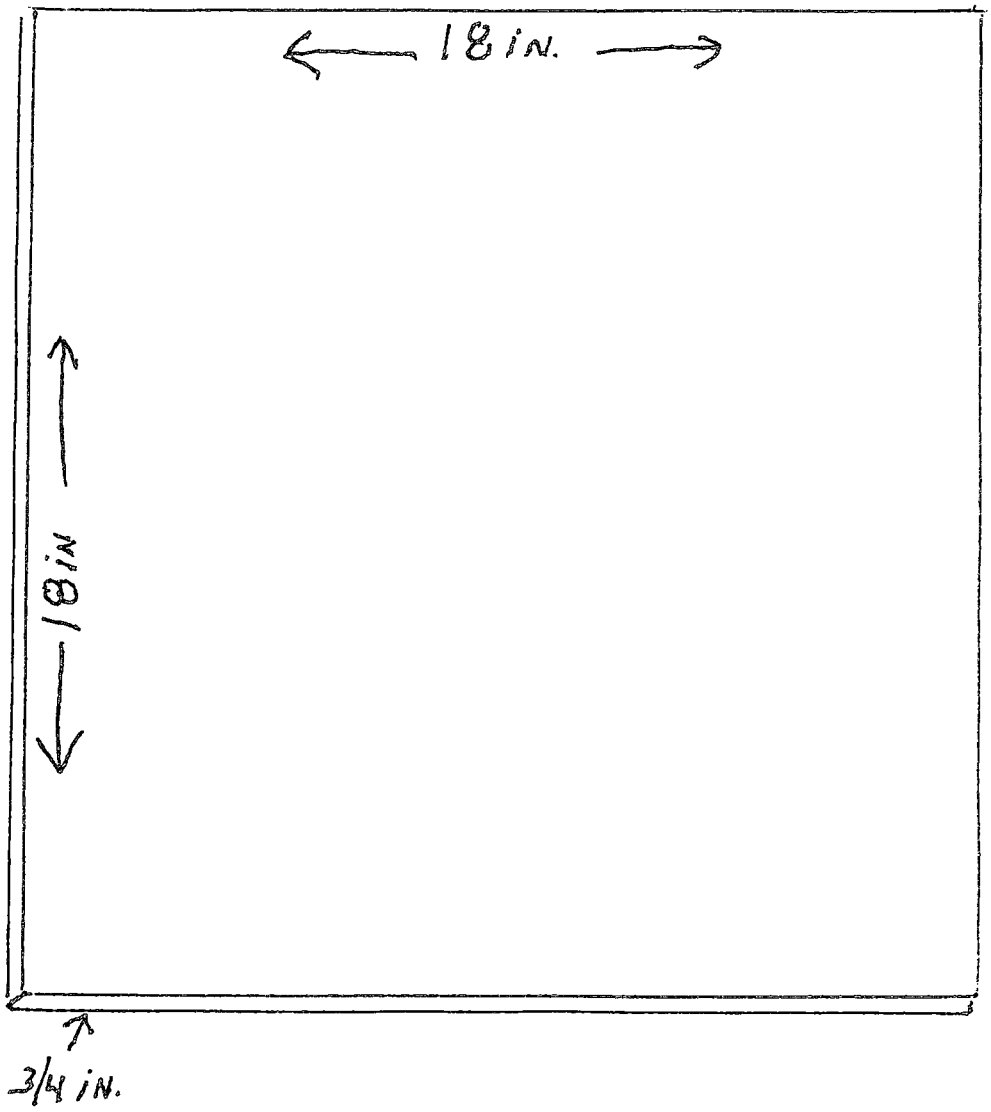
FIG. 4 shows game board base 18"×18"×¾".
Figure 5:
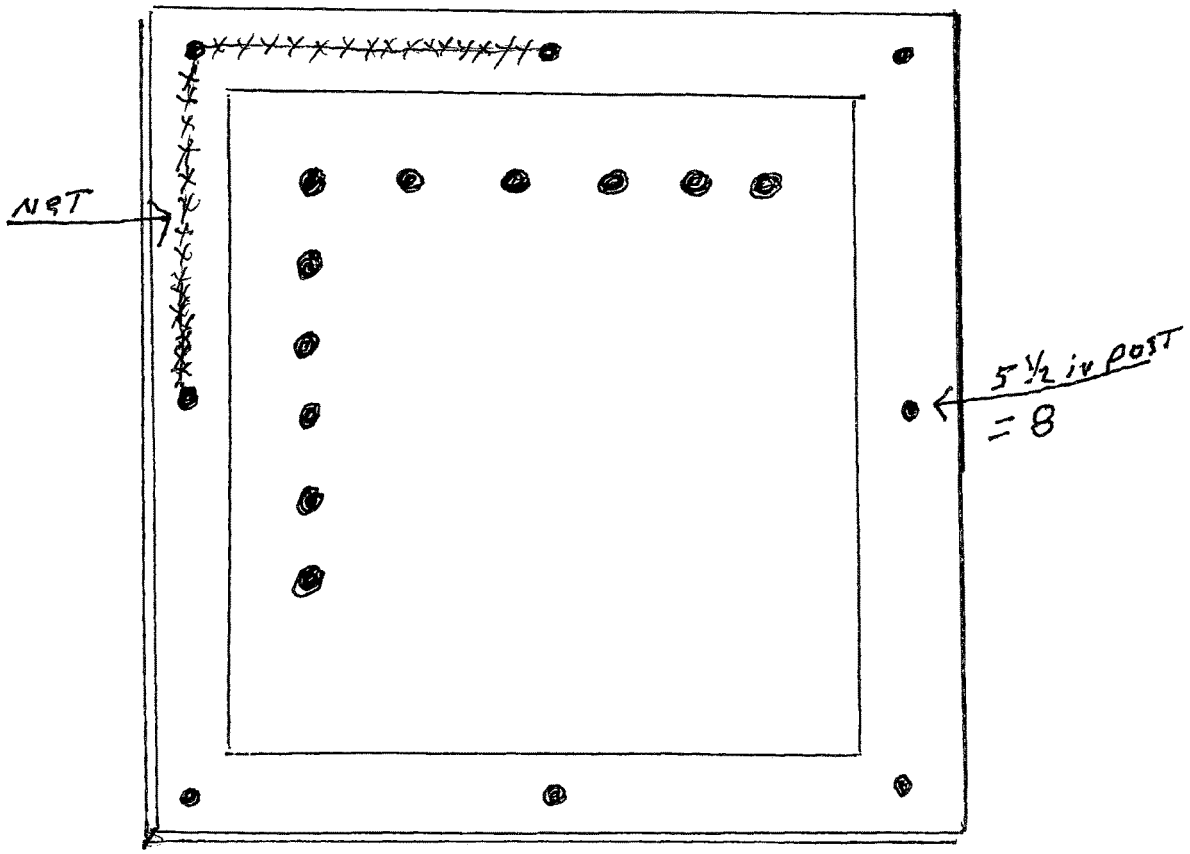
FIG. 5 shows game board on base with placement of 8 posts for 5/812" netting.
Figure 6:
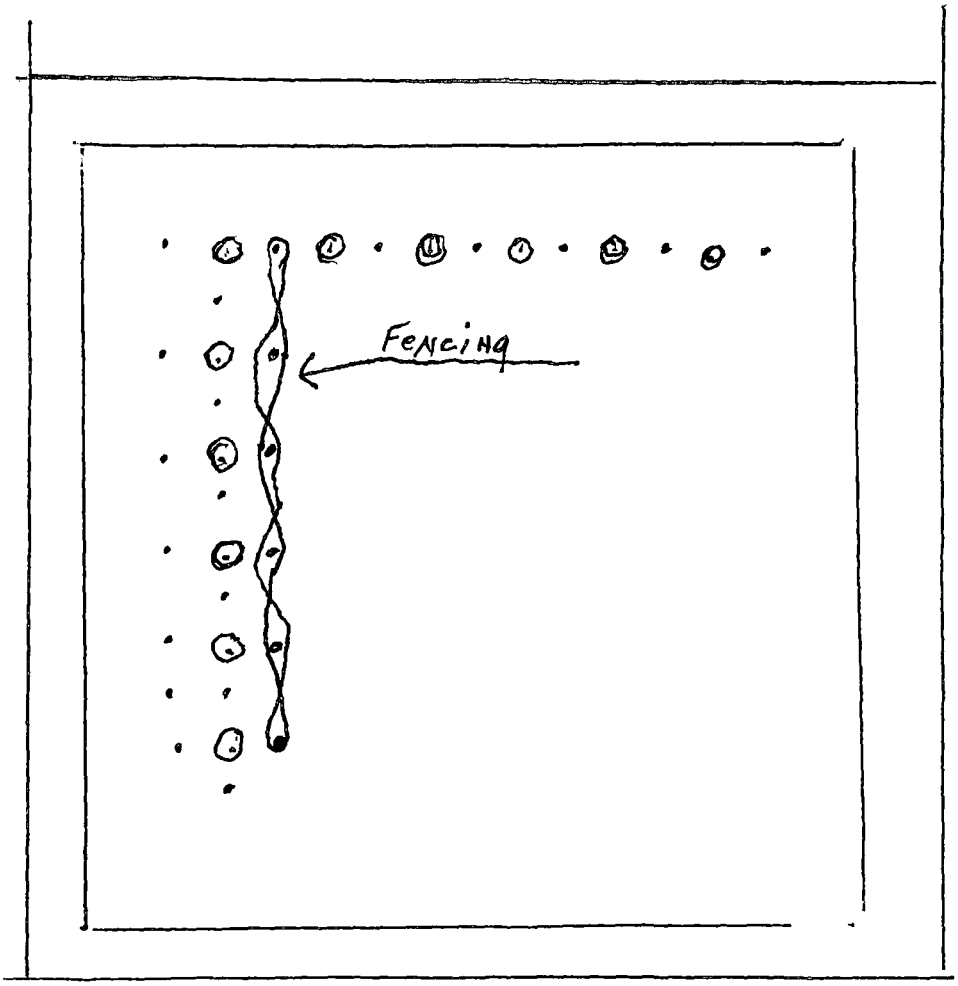
FIG. 6 shows fencing consisting of rubber bands placed on select rows of pins. Fencing attached to pin rows between holes/slots in one direction only.
Figure 7:
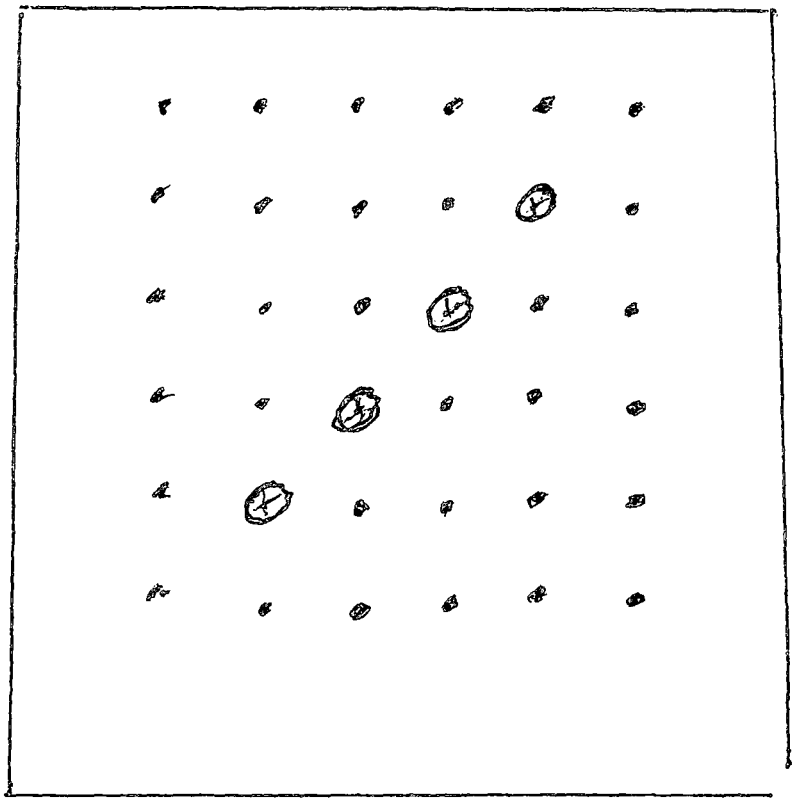
FIG. 7 Four balls diagonal wins.
Figure 8:
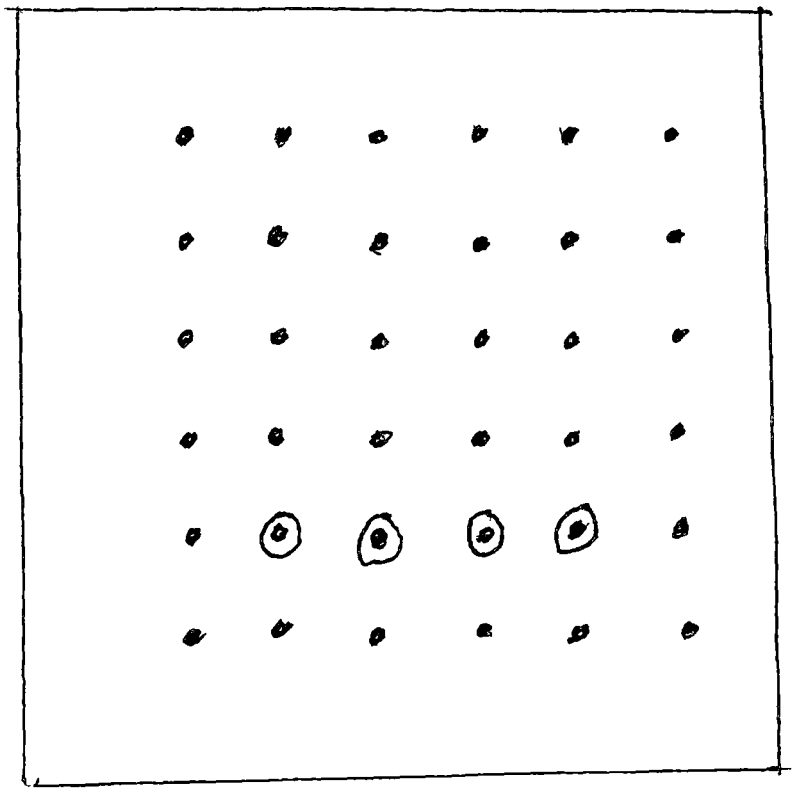
FIG. 8 Four balls straight line wins.
Figure 9:
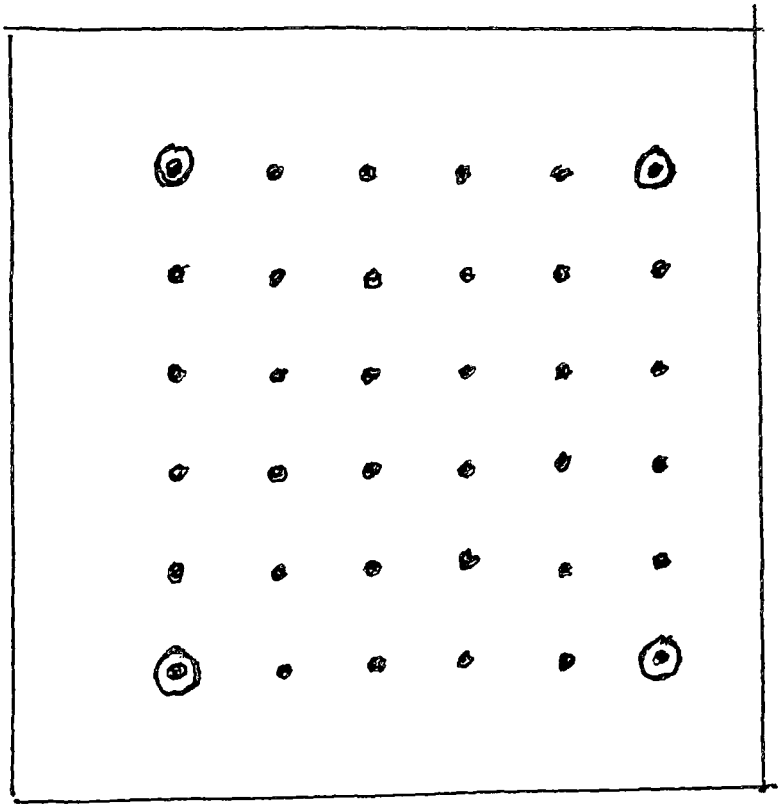
FIG. 9 Four balls, one in all four corners wins.

The plurality of rubber bands serves as a fencing system to guide and direct balls toward the cavities during gameplay, as shown in FIG. 6. The rubber band fencing is constructed by stretching durable rubber bands between rows or columns of the plurality of posts, with each rubber band extending across an entire row or column of posts in one direction only. The fencing is attached to the top portions of the pins and covers void sections between the cavities but does not obstruct the openings of the cavities themselves. This fencing arrangement creates barriers that prevent balls from settling in areas between cavities while still allowing balls to enter the intended cavity openings. The user assembles the fencing system by wrapping thirteen rubber bands around the posts: six rubber bands extend horizontally across the six rows or columns of posts that separate the rows or columns of cavities, and one additional rubber band may be used for reinforcement or alternate configuration. The fencing may be placed around the posts defining the perimeter of the cavities. The fencing system increases the probability that bounced balls will be directed into one of the thirty-six cavities rather than remaining in the void areas between cavities, thereby improving gameplay by ensuring that balls either land in scoring positions or can be easily retrieved for subsequent attempts.

Number of players: Two, Three or Four may play. Players sit on opposite sides of the game board. For four players, the game is played in teams of two. Play proceeds in clockwise rotation.

Balls: Up to three different colored ping pong balls or three different markings on each ball played Game/Round is over when one player/team completes a row of four balls or a ball in all four corners.

Rules:

Game board should be placed on flat surface with at least a foot of clearance on all four sides.

Each player takes a turn bouncing a ball from outside the netting, attempting to land the ball in to one of the slots/cavities. If the ball lands anywhere on the board other than an available slot/cavity or outside the board, this is considered a miss and play goes to the next person.

When one person/team completes a consecutive line of four balls in a row or all four corners, the round is over. Best two out of 3 rounds wins the game.

What is claimed is:

1. A game board assembly, configured for playing an adjacent ball game, the game board assembly comprising:

a game board consisting of thirty-six cavities arranged in a six by six grid of cavities;

a plurality of posts, one post of the plurality of posts arranged above, beneath, to the left, and to the right of each cavity, for a total of four posts surrounding each cavity and a total of eighty-four posts arranged over the six by six grid of cavities;

wherein an alignment of six cavities defines a row of cavities, with a total of six rows of cavities spread over the six by six grid of cavities;

the game board further comprising thirteen rubber bands, where five of the thirteen rubber bands are separately wrapped around six aligned posts that are arranged between two rows of cavities and where eight of the thirteen rubber bands are separately wrapped around three aligned posts that are not arranged between any rows of cavities, such that the five rubber bands define five fences across and within the six by six grid of cavities while the eight rubber bands define eight fences at least partially across and without the six by six grid of cavities;

netting posts uprightly arranged on the perimeter of the game board;

a net arranged on the netting posts such that the six by six grid of cavities is located within the net; and, wherein tossing a ball so that the ball bounces over the net onto the game board and within the six by six grid results in either the ball being directed into one of the thirty-six cavities by at least one of the thirteen rubber bands or the ball being on an outside of all of the thirty six cavities.

2. The game board assembly of claim 1, wherein each of the thirty-six cavities has a circular opening with a diameter of approximately ⅞ inch.

3. The game board assembly of claim 2, wherein the thirty-six cavities are spaced approximately 2 inches center-to-center from adjacent cavities.

4. The game board assembly of claim 3, wherein the game board has dimensions of approximately 15 inches by 15 inches.

5. The game board assembly of claim 4, further comprising a game board base having dimensions of approximately 18 inches by 18 inches by ¾ inch thickness.

6. The game board assembly of claim 5, wherein the eighty-four posts have dimensions of approximately 9/16 inch by ½ inch and stand approximately 1¾ to 1⅞ inches high.

7. The game board assembly of claim 6, wherein the thirteen rubber bands are constructed from durable rubber material.

8. The game board assembly of claim 7, wherein the net has a height of approximately 5½ inches surrounding all sides of the playing area.

9. The game board assembly of claim 8, wherein the netting posts comprise eight posts positioned around the outer edges of the game board base.

10. The game board assembly of claim 9, wherein the ball comprises a ping pong ball.

11. The game board assembly of claim 10, wherein the thirteen rubber bands are attached to top portions of the eighty-four posts.

12. The game board assembly of claim 11, wherein the five rubber bands positioned between rows of cavities prevent balls from settling in void areas between the cavities.

13. The game board assembly of claim 12, wherein the two rubber bands positioned outside the six by six grid provide perimeter fencing for the game board assembly.

14. The game board assembly of claim 13, wherein the net completely surrounds the six by six grid of cavities with no gaps for player access within the net.

15. The game board assembly of claim 14, wherein players must stand outside the net perimeter and bounce balls over the net to access the playing area.

16. The game board assembly of claim 15, wherein the game board assembly requires at least one foot clearance on all four sides for proper setup and gameplay.

17. The game board assembly of claim 16, wherein winning occurs when a player achieves four balls in a straight line, diagonal, two by two at center, or four corners pattern within the six by six grid.

18. The game board assembly of claim 17, wherein the game board assembly accommodates two, three, or four players, with four-player games using teams of two players.

19. The game board assembly of claim 18, wherein balls that do not clear the net may be replayed once per turn.

20. The game board assembly of claim 19, wherein the rubber band fencing system increases the probability that bounced balls will be directed into one of the thirty-six cavities rather than remaining in void areas between cavities.

* * * * *